US010851740B2

(12) United States Patent
Sommerhoff et al.

(10) Patent No.: US 10,851,740 B2
(45) Date of Patent: Dec. 1, 2020

(54) METHODS AND SYSTEMS FOR A CONDENSATE TRAP IN A COMPRESSOR INLET

(71) Applicant: Ford Global Technologies, LLC, Dearborn, MI (US)

(72) Inventors: Franz Arnd Sommerhoff, Aachen (DE); Helmut Kindl, Aachen (DE); Joerg Kemmerling, Monschau (DE); Vanco Smiljanovski, Bedburg (DE); Andreas Kuske, Geulle (NL); Hanno Friederichs, Aachen (DE); Guenter Grosch, Vettweiss (DE); Claudia Herudek, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 233 days.

(21) Appl. No.: 16/007,888

(22) Filed: Jun. 13, 2018

(65) Prior Publication Data

US 2018/0372032 A1 Dec. 27, 2018

(30) Foreign Application Priority Data

Jun. 23, 2017 (DE) ..... 10 2017 210 648

(51) Int. Cl.

| | |
|---|---|
| ***F02M 26/35*** | (2016.01) |
| ***F02M 26/06*** | (2016.01) |
| ***F02M 35/08*** | (2006.01) |
| *F02B 29/04* | (2006.01) |
| *F02B 33/40* | (2006.01) |
| *F02B 37/18* | (2006.01) |

(52) U.S. Cl.

CPC ..... *F02M 26/35* (2016.02); *F02M 26/06* (2016.02); *F02M 35/088* (2013.01); *F02B 29/0418* (2013.01); *F02B 33/40* (2013.01); *F02B 37/18* (2013.01)

(58) Field of Classification Search

CPC ..... F02M 26/35; F02M 26/06; F02M 35/088; F02B 33/00; F02B 37/00; F02B 39/00; F02B 39/16; F02B 39/162; F02B 39/005

USPC ..... 123/528, 559.1; 60/598, 605.2, 309

See application file for complete search history.

(56) References Cited

U.S. PATENT DOCUMENTS

| | | | | |
|---|---|---|---|---|
| 8,418,461 | B2 * | 4/2013 | Siuchta | F02M 26/30 60/605.1 |
| 8,707,935 | B2 | 4/2014 | Weber et al. | |
| 9,500,119 | B2 * | 11/2016 | Lischer | F02M 26/19 |
| 2008/0028757 | A1 * | 2/2008 | Eitel | F01N 3/021 60/311 |

(Continued)

FOREIGN PATENT DOCUMENTS

| | | | |
|---|---|---|---|
| DE | 102005050133 | A1 | 4/2006 |
| DE | 102010042442 | A1 | 5/2011 |

(Continued)

*Primary Examiner* — Mark A Laurenzi
*Assistant Examiner* — Mickey H France
(74) *Attorney, Agent, or Firm* — Geoffrey Brumbaugh; McCoy Russell LLP

(57) ABSTRACT

Methods and systems are provided for a turbocharger comprising a compressor inlet shaped to mitigated condensate formation therein. In one example, system may include a condensate trap which runs along an inner wall of the compressor inlet and is shaped to trap condensate.

20 Claims, 3 Drawing Sheets

(56) References Cited

U.S. PATENT DOCUMENTS

| | | | | |
|---|---|---|---|---|
| 2009/0000297 | A1* | 1/2009 | Joergl | F02M 26/35 60/605.3 |
| 2011/0011084 | A1* | 1/2011 | Yanagida | F02M 35/084 60/605.2 |
| 2016/0069302 | A1 | 3/2016 | Tabata | |
| 2016/0108802 | A1* | 4/2016 | Smiljanovski | F02M 26/09 60/605.2 |
| 2016/0186701 | A1 | 6/2016 | Ariizumi et al. | |
| 2016/0305374 | A1* | 10/2016 | Jayakar | F02M 26/43 |
| 2017/0002773 | A1* | 1/2017 | Segawa | F02B 29/02 |
| 2017/0030305 | A1* | 2/2017 | Sugiyama | F02D 41/0047 |
| 2017/0167449 | A1* | 6/2017 | Choi | F02D 41/0065 |
| 2018/0361289 | A1* | 12/2018 | Suzuki | B01D 45/12 |

FOREIGN PATENT DOCUMENTS

| | | | |
|---|---|---|---|
| DE | 102015200053 | A1 | 7/2015 |
| WO | 2006126993 | A1 | 11/2006 |
| WO | 2015111679 | A1 | 7/2015 |

* cited by examiner

METHODS AND SYSTEMS FOR A CONDENSATE TRAP IN A COMPRESSOR INLET

CROSS REFERENCE TO RELATED APPLICATION

This application claims priority to German Patent Application No. 102017210648.4, filed Jun. 23, 2017. The entire contents of the above-referenced application are hereby incorporated by reference in their entirety for all purposes.

FIELD

The present description relates generally to mitigating condensate formation in a compressor inlet.

BACKGROUND/SUMMARY

Turbochargers or exhaust-gas turbochargers may increase the efficiency of internal combustion engines. Supercharged piston engines may exhibit, in part, considerably increased power compared with non-supercharged, naturally aspirated engines. For the purpose of supercharging, the combustion air supplied to the internal combustion engine may be compressed a compressor. The compressor may introduce a larger quantity of air into the internal combustion engine and thus burn more fuel per piston cycle. In an exhaust-gas turbocharger, the compressor is coupled to a turbine. The turbine may be rotated by way of the kinetic energy of the exhaust gas discharged from the combustion chamber and, in this way, drives the compressor.

An exhaust-gas recirculation (EGR) arrangement may reduce nitrogen oxides ($NO_x$) that form during the combustion of fuel. This may be demanded with regard to the emission limit values which are prescribed for modern motor vehicle engines in relation to pollutant emissions. In the exhaust-gas recirculation arrangement, the combustion air which is supplied to the internal combustion engine is mixed with exhaust gas. Due to the admixing of exhaust gas, the oxygen content of the combustion air, and thus also the combustion rate of the fuel, decrease. This results in a decrease in the combustion temperature. The reaction rate for the formation of nitrogen oxides depends on the combustion temperature, and for this reason a lower combustion temperature leads to a reduced formation of nitrogen oxides.

Through the use of a turbocharger together with an exhaust-gas recirculation arrangement, it is possible for the efficiency of internal combustion engines to be increased and at the same time for the pollutant emissions to be reduced. Especially with regard to future emission limits for exhaust-gas and $CO_2$ emission limit values, in particular during driving operation (real drive emission—RDE), the use of an exhaust-gas recirculation arrangement, specifically a low-pressure exhaust-gas recirculation (LP EGR) arrangement, is desired to be operational through a broad range of the engine characteristic map and at low ambient temperatures (up to minus 7° C.).

For example, DE 10 2010 042 442 A1 discloses a low-pressure EGR system for an internal combustion engine of a motor vehicle with an exhaust-gas turbocharger. The exhaust-gas turbocharger has a compressor and a turbine, a compressor which is arranged in a compressor housing being coupled in a torque-transmitting manner via a shaft to a turbine which is arranged in a turbine housing. The turbine is set in rotation by the exhaust-gas stream of the internal combustion engine and drives the compressor. The compressor housing is connected to a supply line via which the combustion air can be supplied to the compressor. In a low-pressure EGR system, the exhaust gas is extracted downstream of the turbine, that is to say behind the turbine of the turbocharger in the flow direction. The exhaust gas is cooled down to a lower temperature via an EGR cooler and is subsequently mixed with the combustion air via a recirculation line which opens into the supply line. The exhaust-gas/air mixture already generated ahead of the compressor is subsequently supplied to the compressor.

The recirculated exhaust gas contains water vapor. Water vapor may condense in response to a condensation point of the exhaust-gas/air mixture being reached. Specifically at low ambient temperatures, it is possible for the temperature of the exhaust-gas/air mixture to be lowered such that a formation of condensed liquid or the formation of condensation droplets can occur upstream of the compressor, that is to say ahead of the compressor in the flow direction. The low ambient temperature affects in particular the walls of the supply line and the walls of the compressor housing such that, in the supply line and in the region of the compressor inlet, a condensate film can form on the inner sides of the respective walls. The compressor inlet may comprise a conical shape, that is to say the cross-sectional surface, in particular the diameter, narrows in the direction of the compressor rotor, as a result of which the flow speed of the exhaust-gas/air mixture increases. Due to the exhaust-gas/air flow, the condensate film is moved ever further in the direction of the compressor rotor until finally a sufficiently large quantity of condensate has accumulated, or the height of the condensate film and/or the flow speed have grown such that large condensate drops separate from the wall. Tests have shown that, because of their larger mass and the associated larger momentum, specifically these large condensate drops may degrade the blade ends of the compressor, this being referred to as "drop impingement." Specifically the blade ends of the compressor are subjected to increased load since the maximum acceleration or the maximum torque acts thereon. The striking of large condensate drops, as can be formed from a condensate film particularly in the wall region of the supply line and of the compressor inlet, on the blade ends can thus lead to a shortening of the service life of the compressor.

In order to avoid such damage, an exhaust-gas turbocharger for a low-pressure EGR system is known from DE 10 2015 200 053 A1, which is intended to avoid, or at least reduce to a minimum, the precipitation of condensate in the case of a mixture of air and exhaust gas upstream of the compressor rotor. For this purpose, an inlet duct for combustion air and individual entrances for exhaust gas are arranged just in front of the compressor rotor in order to produce a mixture of air and exhaust gas only directly prior to the compression and, in this way, to shorten the time for the precipitation of condensate. However, it is possible that the formation of condensate is consequently displaced to the region behind the compressor rotor. While this may increase the compressor lifespan, the accumulated condensate downstream of the compressor may be swept to the combustion engine and decrease combustion stability, engine efficiency, and power output.

Another possibility for avoiding damage to the blade ends of a compressor rotor is described in WO 2006/126993 A1. The compressor rotor consisting of aluminum is provided with a coating which is intended to protect the blade ends against erosive and corrosive constituents of the exhaust gas and, in this way, to increase the service life of the compressor. In the case of this possibility, however, formation of condensate or ingress of condensate drops into the region of the compressor rotor is not prevented. However, aluminum may increase manufacturing costs and affect compressor geometry.

In view of the previous examples described above, there is still a demand to improve a turbocharger, in particular an exhaust-gas turbocharger, for an internal combustion engine, for use with an EGR device such that the blades, in particular the blade ends, of the compressor rotor are protected against condensate drops. It is furthermore sought to specify an EGR device with a turbocharger, which device has improved condensate drop protection.

In one example, the issues described above may be addressed by a turbocharger for an internal combustion engine. The turbocharger has a compressor in order to compress the intake air or the combustion air for the internal combustion engine. The turbocharger also has an exhaust-gas turbine. The exhaust-gas turbine is rotated by the exhaust gases generated during the combustion and serves for driving the compressor. The exhaust-gas turbine is connected in a torque-transmitting manner to the compressor, for example via a common shaft. In the flow direction, the internal combustion engine is arranged behind the compressor, that is to say downstream of the compressor, and ahead of the exhaust-gas turbine, that is to say upstream of the exhaust-gas turbine. A charge-air cooler for cooling the compressed intake air may optionally be arranged between the compressor and the internal combustion engine. The compressor has a compressor housing in which a compressor rotor is arranged. The compressor housing defines a compressor inlet upstream of the compressor rotor. The compressor inlet is formed such that it is able to be connected to a supply line of an EGR device, in particular a low-pressure EGR device. The intake air contained in the supply line is mixed with exhaust gas prior to reaching the compressor. It is possible, for example via a recirculation line which opens into the supply line, for the exhaust gas to be extracted from the EGR device.

Herein, the compressor inlet may comprise a condensate trap which is formed for trapping condensate and decrease condensate formation and/or accumulation onto walls of the compressor inlet, thereby decreasing a likelihood of degradation to the blade ends, as a result of drop impingement. For this purpose, the condensate trap has at least one first barrier. The first barrier runs along an inner wall of the compressor inlet and is formed for trapping condensate. The condensate trap also has at least one condensate drain, which is formed for discharging the condensate. For this purpose, the condensate drain is fluidically connected to the first barrier and supplies the trapped condensate for example to a reservoir or a tank in order to be used for example for the purpose of water injection into the combustion chamber. "Fluidically connected" means that a fluid is able to flow in both directions, from the first barrier to the condensate drain or vice versa. The condensate trap may have one or more discharge ducts which may be formed in an annular manner inside the region of the compressor inlet in the compressor housing and are in each case fluidically connected to the first barrier.

According to an embodiment, the first barrier of the condensate trap may be formed as a trap groove or channel or recess. The trap groove runs at least partially in an annular manner, that is to say in a continuous or interrupted manner, along the inner wall of the compressor inlet. A condensate film which has formed on the inner wall of the compressor inlet can be trapped via the trap groove and further movement of the condensate film in the direction of the compressor rotor may be prevented and/or mitigated.

In another embodiment, additionally or alternatively, an oblique design of the trap groove, that is to say where the trap groove forms an obtuse angle with the inner wall of the compressor inlet, increases the effect of the ability of the trap groove to capture condensate. As a result of the discharge of condensate via the condensate drain, it is furthermore possible to prevent the condensate film reaching a critical height at which condensate drops separate therefrom and are entrained by the exhaust-gas/air mixture flow in the direction of the compressor rotor.

In some embodiments, additionally or alternatively, the condensate film comprises a second barrier, which is formed for backing up the condensate as a step, edge or web projecting radially from the inner wall of the compressor inlet into the interior of the compressor inlet. Such a back-up step may run at least partially in an annular manner along the inner wall of the compressor inlet. The back-up step may mitigate or prevent movement of the condensate film in the direction of the compressor rotor and also trap condensate drops which have already separated from the condensate film. In this way, the second barrier may function as a fail-safe with regard to the trap groove in the unlikely circumstance where condensate may move past the trap groove toward the compressor. In one example, the back-up step serves for avoiding drop impingement. Condensate which is trapped, or backed up, via the back-up step may be delivered directly to the trap groove. Thus, the trap groove is expediently arranged upstream of the back-up step, the back-up step being formed as an extension of the downstream wall of the trap groove and thus being able to form an acute angle with the inner wall of the compressor inlet. The inner wall of the compressor inlet may, for this purpose, have a first, conical region and a second, straight region, the diameter of the second, straight region being larger than the diameter of the first, conical region.

According to the disclosure, the compressor housing may have a condensate chamber. The condensate chamber may be fluidically connected to the condensate trap for the purpose of collecting the trapped condensate, and may be formed as a recess or hollow volume inside the compressor housing. According to some embodiments, the condensate chamber is arranged between the first barrier and the condensate drain and is fluidically connected to them. In this way, the condensate chamber serves as a compensation volume for the case where a quantity of condensate forms inside the compressor inlet, and is trapped by the first barrier, which is larger than the condensate drain is capable of discharging. The condensate chamber too may run at least partially, or in some examples around the entire circumference, in an annular manner inside the compressor housing and may also be referred to as an annular duct.

In order to be able to trap condensate which precipitates close to a front of the compressor rotor, the condensate trap may be arranged directly in front of the compressor rotor. As already described above, the quantity of condensate precipitating out depends inter alia on the duration over which the exhaust-gas/air mixture is exposed to temperatures which are below the condensation temperature thereof. The fact that the condensate trap is arranged directly in front of the compressor rotor mitigates and/or prevents precipitation of condensate downstream of the condensate trap and upstream of the compressor.

The disclosure is further directed to an exhaust-gas recirculation device (EGR device) with a turbocharger which has the above-described features. The EGR device comprises an EGR path with at least one discharge line, with at least one supply line, with an EGR cooler arranged between said lines, and with a recirculation line. The discharge line is connected to an exhaust-gas turbine outlet of the turbocharger or adjoins this. The discharge line can be connected directly or indirectly to the exhaust-gas turbine outlet. That is to say, an exhaust-gas aftertreatment device, for example a particle filter, may be arranged between the exhaust-gas turbine outlet and the discharge line or even such that the discharge line is interrupted. The discharge line supplies the exhaust gas to an EGR cooler which lowers the temperature of the exhaust gas prior to the mixture with the intake air. The recirculation line is connected to the EGR cooler and opens into the supply line, which guides the intake air, with the result that an exhaust-gas/air mixture already forms inside the supply line, said mixture then being supplied to the compressor. For this purpose, the compressor inlet is fluidically connected to the supply line. Various valves and/or throttles may be arranged inside the EGR path.

In one example, the issues described above may be at least partially solved by a turbocharger for an internal combustion engine, comprising, a compressor shaped to compress intake air flowing to the internal combustion engine, the turbocharger further comprising an exhaust-gas turbine for driving the compressor, the compressor further comprising a compressor rotor in a compressor housing defining a compressor inlet upstream of the compressor rotor, the compressor inlet fluidically connected to at least one supply line of a EGR device, wherein the compressor inlet comprises a condensate trap which has at least one barrier, which runs along an inner wall of the compressor inlet, shaped to capture condensate, and which has at least one condensate drain for discharging condensate. In this way, condensate accumulation in the compressor inlet may be mitigated and/or prevented to decrease a number of water droplets being swept to the compressor.

As one example, the at least one barrier may be a first barrier arranged along an upstream inner wall of the compressor. The first barrier may be a groove machined into the upstream inner wall. The compressor inlet may further comprise a second barrier arranged along a downstream inner wall, closer to the compressor rotor than the first barrier. The first and second barriers may work in combination to decrease condensate build up in the compressor inlet. By doing this, low-pressure exhaust-gas recirculate (LP-EGR) may be used during a greater range of engine operating conditions, for example during engine operating conditions where condensate build up increases (e.g., during a cold-start). As a result, $NO_x$ emissions and overall vehicle emissions may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Furthermore, the features and measures specified individually in the following description may be combined with one another in any desired technically meaningful way and disclose further configurations of the disclosure. The description, in particular in conjunction with the figures, characterizes and specifies the disclosure further.

BRIEF DESCRIPTION OF THE DRAWINGS

FIG. 2 is shown approximately to scale.

DETAILED DESCRIPTION

The following description relates to systems and methods for features arranged in a turbocharger to decrease condensate accumulation in a compressor inlet. In some embodiments, walls of the compressor inlet may include one or more shapes for trapping condensate as it is pushed toward a compressor. An example turbocharger and engine are shown in FIGS. 1 and 3.

The compressor inlet may comprise a variety of geometries leading to the compressor rotor. In some examples, the compressor inlet may comprise an upstream wall comprising a conical shape and a downstream wall comprising a flat shape. A first barrier may be arranged on the upstream wall and a second barrier may be arranged on the downstream wall. Furthermore, the first barrier may be machined at an angle greater than an angle of the second barrier. The shape of the first and second barriers may work in tandem to decrease condensate accumulation. The first and second barriers are shown in FIG. 2.

Figure 1:
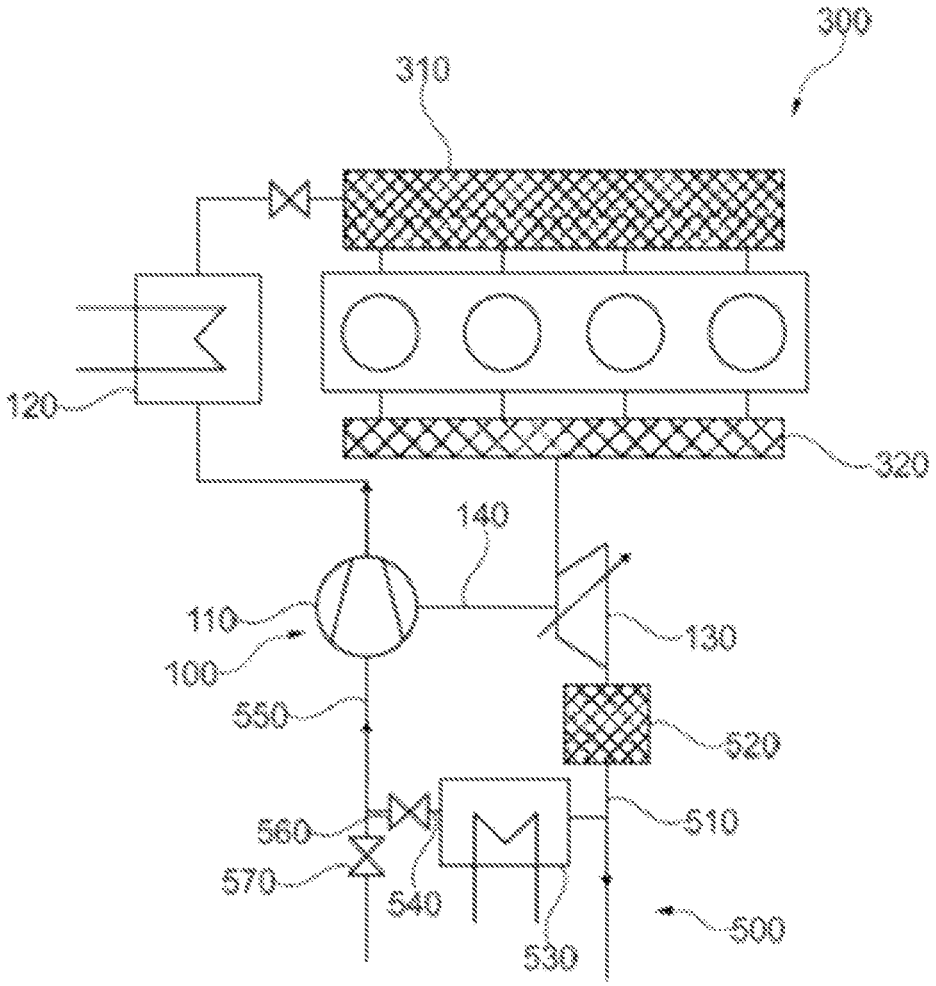
FIG. 1 shows a schematic, exemplary flow diagram of a turbocharger for an internal combustion engine, with a low-pressure EGR device.
Figure 2:
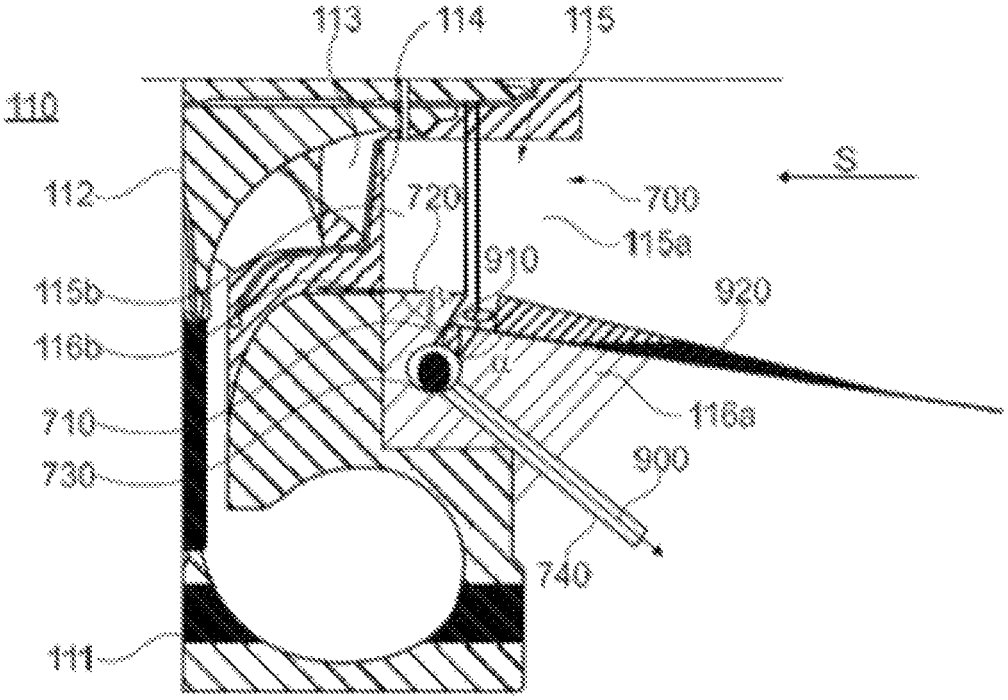
FIG. 2 shows a section through a compressor of a turbocharger with a schematic illustration of a condensate trap according to the disclosure.
Figure 3:
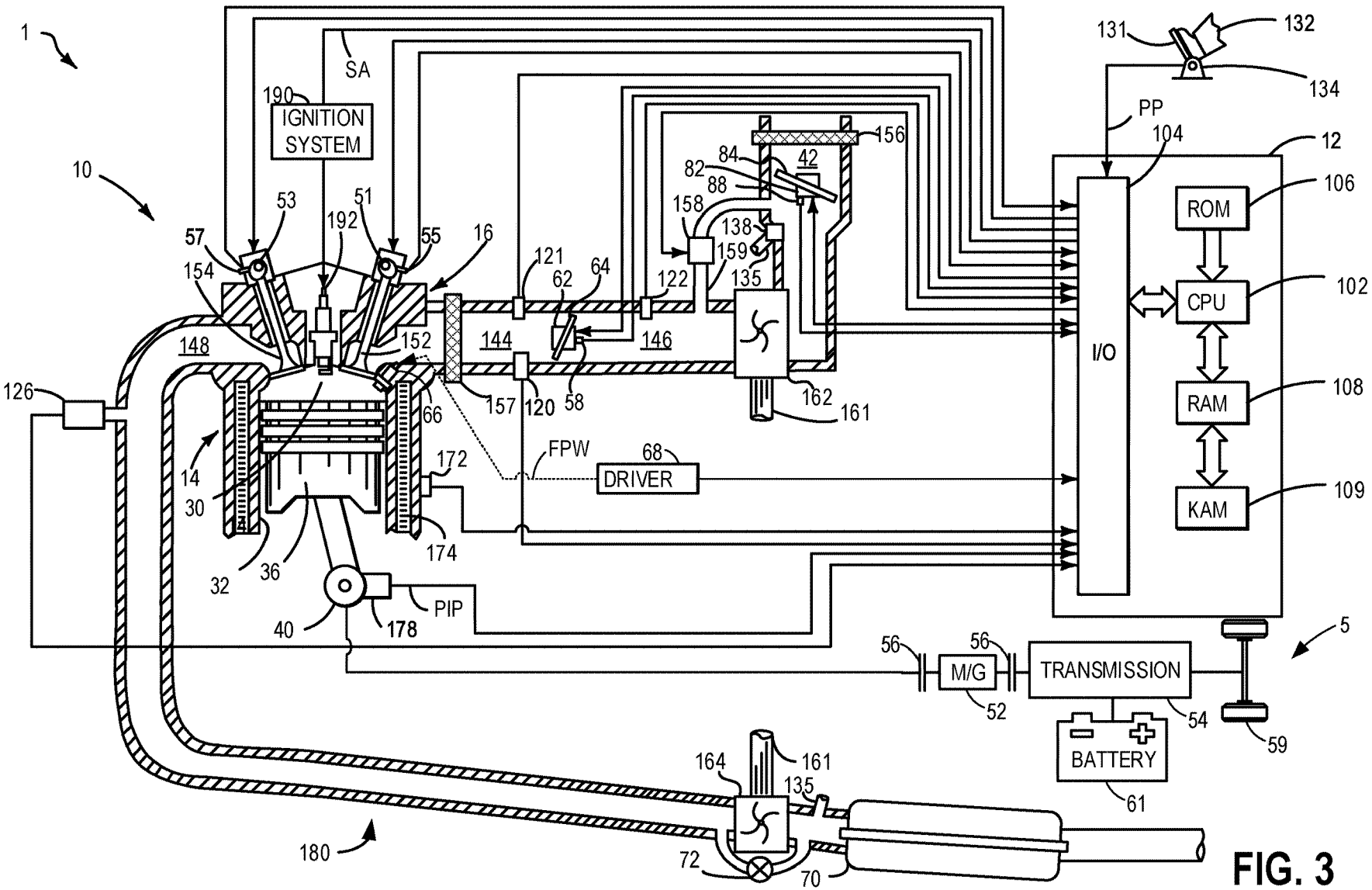
FIG. 3 shows a schematic of an engine of a hybrid-vehicle.

FIGS. 1-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Note that FIG. 2 shows arrows indicating where there is space for gas to flow, and the solid lines of the device walls show where flow is blocked and communication is not possible due to the lack of fluidic communication created by the device walls spanning from one point to another. The walls create separation between regions, except for openings in the wall which allow for the described fluid communication.

Turning now to FIG. 1, it illustrates a schematic of a turbocharger 100 for an internal combustion engine 300, with a low-pressure EGR device 500. A compressor 110 may compress the intake air intended for the internal combustion engine 300 or an exhaust-gas/air mixture and optionally fluidically connected to a charge-air cooler 120. In some examples, a charge-air cooler 120 bypass may be included to allow charge-air to flow around the charge-air cooler 120 without cooling. During the compression, energy is supplied to the exhaust-gas/air mixture, leading to an increase in the temperature thereof. The charge-air cooler 120 serves for cooling the exhaust-gas/air mixture in a manner known per se.

The charge-air cooler 120 is furthermore fluidically connected to an intake manifold 310 via which the exhaust-gas/air mixture is supplied to the cylinders of the internal combustion engine 300. The exhaust gas generated during the combustion is supplied to an exhaust-gas turbine 130 via an exhaust manifold 320. The exhaust-gas turbine 130 is set in rotation via the kinetic energy of the exhaust gas and transmits its torque to the compressor 110 via a shaft 140.

The exhaust-gas turbine 130 is adjoined by an EGR path of the low-pressure EGR device 500 via a discharge line 510. It is possible, by way of example, for a particle filter 520 or some other exhaust-gas aftertreatment device to be arranged within the path of the discharge line 510. The discharge line 510 supplies a part of the exhaust gas to an EGR cooler 530. The EGR cooler 530 is adjoined by a recirculation line 540 which opens into a supply line 550. The recirculation line 540 may have an EGR valve 560. The supply line 550 is supplied with fresh air via a throttle valve 570. Downstream of the throttle valve 570, the recirculation line 540 opens into the supply line 550 and adds the recirculated exhaust gas thereto. The supply line 550 opens into the compressor 110, as a result of which the latter is fed with an exhaust-gas/air mixture.

The compressor 110 has a condensate trap 700 according to the disclosure, as illustrated in FIG. 2.

Turning now to FIG. 2, it shows a schematic illustration of one half of a compressor 110 with a section through the condensate trap 700 according to the disclosure which is formed for trapping condensate 900. The compressor 110 has a compressor housing 111 in which a compressor rotor 112 is arranged. The compressor rotor 112 has blades 113 with blade ends 114. The compressor housing 111 defines a compressor inlet 115 upstream of the compressor rotor 112, that is to say ahead of the compressor rotor 112 in the flow direction S of the exhaust-gas/air mixture. The compressor inlet 115 is subdivided into a first inlet region 115*a* having an inner wall 116*a* which runs in a conical manner and a second inlet region 115*b* having an inner wall 116*b* which runs in a straight manner, wherein the first inlet region 115*a* is arranged upstream of the second inlet region 115*b*. The exemplary embodiment of the condensate trap 700 is arranged inside the compressor inlet 115 in the first inlet region 115*a* and is formed integrally therewith, in particular is milled, drilled or the like therefrom.

The condensate trap 700 has a first barrier 710, which runs in an annular manner along the first inlet region 115*a* of the compressor inlet 115 and is formed as a recess or trap groove inside the conical inner wall 116*a*. The first barrier 710 may be arranged obliquely and forms an obtuse angle $\alpha$ with the conical inner wall 116*a* relative to the flow direction S. In one example, the obtuse angle $\alpha$ is between 95 and 150 degrees. In one example, the obtuse angle $\alpha$ is equal to exactly 120°.

The condensate trap 700 may further optionally comprise a second barrier 720, which may extend in an annular manner, but along the second inlet region 115*b*, downstream of the first barrier 710. The second barrier 720 may be a step or web or edge and projects beyond the first inlet region 115*a*, wherein the second barrier 720 forms an acute angle $\beta$ with the inner wall 116*b* of the second inlet region 115*b*. Herein, the inner wall 116*a* may be referred to as the upstream inner wall 116*a* and the inner wall 116*b* may be referred to as the downstream inner wall 116*b*. In some examples, the acute angle $\beta$ is less than the obtuse angle $\alpha$, wherein the acute angle $\beta$ may be relative to the inner wall 116*b* and between 30 to 90 degrees. In one example, the acute angle $\beta$ is equal to exactly 70°. The first barrier 710 adjoins, with a straight profile, the second barrier 720, with the result that the annular step forms a continuation of the downstream wall of an annular groove of the first barrier 710, which continuation projects radially into the interior of the compressor inlet 115. That is to say, the second barrier 720 may extend in a direction substantially perpendicular to the inner wall 116*b* downward to the first barrier 710.

A condensate chamber 730 may be arranged between the first barrier 710 and the second barrier 720 and is fluidically connected to the barriers. In some examples, additionally or alternatively, the condensate chamber 730 may be arranged at a location downstream of where the first barrier 710 and the second barrier 720 merge. The condensate chamber 730 may be directly adjoined by the second barrier 720 and can run in an annular manner inside the compressor housing 111 in the region of the compressor inlet 115, and for this reason the condensate chamber may also be referred to as an annular duct 730. In one example, the condensate chamber 730 is only arranged at a lowest portion of the compressor 110 relative to gravity, such that condensate captured in the first barrier 710 and the second barrier 720 may fall directly to the condensate chamber 730.

At least one condensate drain 740 may be fluidically connected to the condensate chamber 730. The condensate drain 740 may be in the form of a line, duct, or the like and may guide the condensate 900 into a reservoir or a tank (not illustrated), from where said condensate is able to be removed for example for the purpose of injection into the combustion chamber or may be released to a location outside of the vehicle (e.g., a ground or ambient atmosphere).

Condensate 910, 920, which is drop-shaped and also formed as film and which may precipitate on the conical inner wall 116*a* of the compressor inlet 115, is trapped or backed up via the second barrier 720 before being able to strike the blades 113, in particular the blade ends 114, of the compressor rotor 112. The condensate 900 is subsequently received by the first barrier 710, which is in the form of an annular groove, and guided to the condensate chamber 730. The condensate chamber 730 is adjoined by the condensate drain 740 in order for the condensate 900 present in the condensate chamber 730 to be discharged from the region of the compressor inlet 115. The interaction of the different components of the condensate trap 700 ensures that large condensate drops 910 which have possibly separated from the condensate film 920 do not strike the blade ends 114 of the blades of the compressor rotor 112. In this way, damage to the blade ends 114 can be avoided and the service life of the compressor 110 can be increased.

Said another way, in some embodiments, the compressor 110 comprises the upstream inner wall 116*a* comprising the first barrier 710 arranged at the obtuse angle α relative to a surface of the upstream inner wall 116*a*. The compressor 110 further comprises the downstream inner wall 116*b* comprising the second barrier 720 arranged at the acute angle β relative to a surface of the downstream inner wall 116*b*. In some examples, the second barrier 720 may be arranged perpendicularly to the downstream inner wall 116*b*. The first and second barriers 710, 720 may work in combination to decrease condensate accumulation in the compressor inlet 115, thereby decreasing a likelihood of large water droplets being swept to the compressor blades 113. This may increase a compressor 110 longevity.

In this way, flowing a mixture of exhaust gas (e.g., LP-EGR) and intake air to the compressor may occur during engine operating conditions where condensate formation is likely. The first and second barriers 710, 720 may work in combination due to their different angles to capture a majority of condensate accumulating in the compressor inlet 115.

FIG. 3 depicts an engine system 1 for a vehicle. The vehicle may be an on-road vehicle having drive wheels which contact a road surface. Engine system 1 includes engine 10 which comprises a plurality of cylinders. Engine 10 may be used similarly to engine 300 of FIG. 1. FIG. 3 describes one such cylinder or combustion chamber in detail. The various components of engine 10 may be controlled by electronic engine controller 12.

Engine 10 includes a cylinder block 14 including at least one cylinder bore 20, and a cylinder head 16 including intake valves 152 and exhaust valves 154. In other examples, the cylinder head 16 may include one or more intake ports and/or exhaust ports in examples where the engine 10 is configured as a two-stroke engine. The cylinder block 14 includes cylinder walls 32 with piston 36 positioned therein and connected to crankshaft 40. Thus, when coupled together, the cylinder head 16 and cylinder block 14 may form one or more combustion chambers. As such, the combustion chamber 30 volume is adjusted based on an oscillation of the piston 36. Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber 30 and cylinder bore 20 may be fluidly sealed, such that gases may not enter or leave the combustion chamber 30.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. The cylinder head 16 may be coupled to the cylinder block 14 via fasteners, such as bolts and/or screws. In particular, when coupled, the cylinder block 14 and cylinder head 16 may be in sealing contact with one another via a gasket, and as such the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 10.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

Fuel injector 66 may be positioned to inject fuel directly into combustion chamber 30, which is known to those skilled in the art as direct injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In some examples, the engine 10 may be a gasoline engine, and the fuel tank may include gasoline, which may be injected by injector 66 into the combustion chamber 30. However, in other examples, the engine 10 may be a diesel engine, and the fuel tank may include diesel fuel, which may be injected by injector 66 into the combustion chamber. Further, in such examples where the engine 10 is configured as a diesel engine, the engine 10 may include a glow plug to initiate combustion in the combustion chamber 30.

Intake manifold 144 is shown communicating with throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, AIS throttle 82 may be omitted and airflow to the engine may be controlled with the throttle 62.

In some embodiments, engine 10 is configured to provide exhaust gas recirculation, or EGR. When included, EGR may be provided as high-pressure EGR and/or low-pressure EGR. In examples where the engine 10 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube. In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. Compressor 162 may be used similarly to compressor 110 of FIGS. 1 and 2. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 1, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from upstream of charge air cooler 157 to the compressor inlet. In alternate examples, compressor recirculation path 159 may be configured to recirculate compressed air from downstream of the compressor and downstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 70. Alternatively, a two-state exhaust gas oxygen sensor may be substituted for UEGO sensor 126. Emission control device 70 may include multiple catalyst bricks, in one example. In another example, multiple emission control devices, each with multiple bricks, can be used. While the depicted example shows UEGO sensor 126 upstream of turbine 164, it will be appreciated that in alternate embodiments, UEGO sensor may be positioned in the exhaust manifold downstream of turbine 164 and upstream of emission control device 70. Additionally or alternatively, the emission control device 70 may comprise a diesel oxidation catalyst (DOC) and/or a diesel cold-start catalyst, a particulate filter, a three-way catalyst, a $NO_x$ trap, selective catalytic reduction device, and combinations thereof. In some examples, a sensor may be arranged upstream or downstream of the emission control device 70, wherein the sensor may be configured to diagnose a condition of the emission control device 70.

Controller 12 is shown in FIG. 1 as a microcomputer including: microprocessor unit 102, input/output ports 104, read-only memory 106, random access memory 108, keep alive memory 109, and a conventional data bus. Controller 12 is shown receiving various signals from sensors coupled to engine 10, in addition to those signals previously discussed, including: engine coolant temperature (ECT) from temperature sensor 172 coupled to cooling sleeve 174; a position sensor 134 coupled to an input device 131 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 178 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, Hall effect sensor 178 produces a predetermined number of equally spaced pulses every revolution of the crankshaft from which engine speed (RPM) can be determined. The input device 131 may comprise an accelerator pedal and/or a brake pedal. As such, output from the position sensor 134 may be used to determine the position of the accelerator pedal and/or brake pedal of the input device 131, and therefore determine a desired engine torque. Thus, a desired engine torque as requested by the vehicle operator 132 may be estimated based on the pedal position of the input device 131.

In some examples, vehicle 5 may be a hybrid vehicle with multiple sources of torque available to one or more vehicle wheels 59. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 40 of engine 10 and electric machine 52 are connected via a transmission 54 to vehicle wheels 59 when one or more clutches 56 are engaged. In the depicted example, a first clutch 56 is provided between crankshaft 40 and electric machine 52, and a second clutch 56 is provided between electric machine 52 and transmission 54. Controller 12 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 59. Electric machine 52 may also be operated as a generator to provide electrical power to charge battery 58, for example during a braking operation.

The controller 12 receives signals from the various sensors of FIG. 3 and employs the various actuators of FIG. 3 to adjust engine operation based on the received signals and instructions stored on a memory of the controller. For example, adjusting operation of the electric machine 52 may occur based on feedback from ECT sensor 112. As will be described in greater detail below, the engine 10 and electric machine 52 may be adjusted such that their operations may be delayed based on one or more of a powertrain temperature, which may be estimated based on feedback from ECT sensor 112, and a distance between an intended destination and an electric-only operation range.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 40 of engine 10 and electric machine 52 are connected via a transmission 54 to vehicle wheels 55 when one or more clutches 56 are engaged. In the depicted example, a first clutch 56 is provided between crankshaft 40 and electric machine 52, and a second clutch 56 is provided between electric machine 52 and transmission 54. Controller 12 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

In this way, a compressor inlet may be shaped to reduce condensate formation therein to allow low-pressure exhaust-gas recirculate to be utilized during a greater range of engine operating conditions. The compressor inlet may include at least one barrier, and in some examples two barriers machined into its walls, the barriers shaped to trap condensate and direct the condensate to a condensate chamber, where the condensate is directed away from the compressor inlet to one or more of a water reservoir or ambient atmosphere. The technical effect of arranging one or more barriers into the compressor inlet is to decrease condensate formation, which may decrease a likelihood of compressor blade degradation.

An embodiment of a turbocharger for an internal combustion engine, comprising a compressor shaped to compress intake air flowing to the internal combustion engine, the turbocharger further comprising an exhaust-gas turbine for driving the compressor, the compressor further comprising a compressor rotor in a compressor housing defining a compressor inlet upstream of the compressor rotor, the compressor inlet fluidically connected to at least one supply line of a EGR device, wherein the compressor inlet comprises a condensate trap which has at least one barrier, which runs along an inner wall of the compressor inlet, shaped to capture condensate, and which has at least one condensate drain for discharging condensate. A first example of the turbocharger further includes where the at least one barrier is formed as a trap groove, the trap groove running at least partially annularly along the inner wall of the compressor inlet, and where the inner wall is an upstream inner wall. A second example of the turbocharger, optionally including the first examples, further includes where the at least one barrier is a first barrier, further comprising a second barrier arranged downstream of the first barrier along a downstream inner wall and running at least partially annularly along the downstream inner wall of the compressor inlet, wherein the downstream inner wall is closer to the compressor rotor than the upstream inner wall. A third example of the turbocharger, optionally including the first and/or second examples, further includes where the compressor housing comprises a condensate chamber which is fluidically connected to the condensate trap, and where the condensate chamber collects condensate trapped by the condensate trap. A fourth example of the turbocharger, optionally including one or more of the first through third examples, further includes where the condensate chamber is arranged between and fluidly connected to each of the first and second barriers. A fifth example of the turbocharger, optionally including one or more of the first through fourth examples, further includes where the at least one barrier of the condensate trap is arranged directly in front of the compressor rotor.

An embodiment of a system comprising a compressor inlet comprising an upstream wall comprising a first condensate trap and a downstream wall comprising a second condensate trap, wherein the first condensate trap is obtusely angled and the second condensate trap is acutely angled relative to intake air flow. A first example of the system further includes where the upstream wall is conical and its diameter decreases in a downstream direction. A second example of the system, optionally including the first example, further includes where the downstream wall is flat and its diameter is fixed. A third example of the system, optionally including the first and/or second examples, further includes where the first condensate trap and the second condensate trap extend at least partially annularly about the upstream and downstream walls, respectively. A fourth example of the system, optionally including one or more of the first through third examples, further includes where each of the first condensate trap and the second condensate trap is fluidically connected to a condensate chamber configured to store condensate. A fifth example of the system, optionally including one or more of the first through fourth examples, further includes where the first condensate trap is fluidically connected to a condensate chamber downstream of a location where the first condensate trap and the second condensate trap intersect. A sixth example of the system, optionally including one or more of the first through fifth examples, further includes where the condensate chamber is fluidically connected to a condensate drain shaped to flow condensate to a water reservoir or an ambient atmosphere. A seventh example of the system, optionally including one or more of the first through sixth examples, further includes where the first condensate trap is flush with the upstream wall and does not constrict an intake air path through the compressor inlet. An eighth example of the system, optionally including one or more of the first through seventh examples, further includes where the second condensate trap is flush with the downstream wall and does not constrict an intake air path through the compressor inlet.

A method comprising flowing a mixture of exhaust gas and intake air to a compressor and capturing condensate accumulating on surfaces of a compressor inlet via a first condensate trap and a second condensate trap, wherein the first condensate trap is more angled than the second condensate trap relative to a general flow direction of the mixture. A first example of the method further includes where the second condensate trap is a step, an edge, or a web arranged on a downstream inlet wall. A second example of the method, optionally including the first example, further includes where the first condensate trap is a recess or groove machined into an upstream inlet wall, and where the upstream inlet wall is farther away from a plurality of compressor blades of the compressor than the downstream inlet wall. A third example of the method, optionally including the first and/or second examples, further includes where the second condensate trap extends into a flow path of the mixture. A fourth example of the method, optionally including one or more of the first through third examples, further includes where the first condensate trap comprises an angle greater than 90° and where the second condensate trap comprises an angle less than 90°.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A turbocharger for an internal combustion engine, comprising:

a compressor shaped to compress intake air flowing to the internal combustion engine, the turbocharger further comprising an exhaust-gas turbine for driving the compressor, the compressor further comprising a compressor rotor in a compressor housing defining a compressor inlet upstream of the compressor rotor, the compressor inlet fluidically connected to at least one supply line of a EGR device, wherein the compressor inlet comprises a condensate trap which has at least one barrier, which runs along an inner wall of the compressor inlet, shaped to capture condensate, and wherein the at least one condensate trap is fluidly coupled directly to at least one condensate drain for discharging condensate, the at least one condensate drain extending from the inner wall to a reservoir.

2. The turbocharger of claim 1, wherein the at least one barrier is formed as a trap groove, the trap groove running at least partially annularly along the inner wall of the compressor inlet, and where the inner wall is an upstream inner wall.

3. The turbocharger of claim 2, wherein the at least one barrier is a first barrier, further comprising a second barrier arranged downstream of the first barrier along a downstream inner wall and extending at least partially annularly along the downstream inner wall of the compressor inlet, wherein the downstream inner wall is closer to the compressor rotor than the upstream inner wall.

4. The turbocharger of claim 3, wherein the compressor housing comprises a condensate chamber which is fluidically connected to the condensate trap, and where the condensate chamber collects condensate trapped by the condensate trap.

5. The turbocharger of claim 4, wherein the condensate chamber is arranged between and fluidly connected to each of the first and second barriers.

6. The turbocharger of claim 1, wherein the at least one barrier of the condensate trap is arranged directly in front of the compressor rotor.

7. A system, comprising:

a compressor inlet comprising an upstream wall comprising a first condensate trap and a downstream wall comprising a second condensate trap, wherein the first condensate trap is obtusely angled and the second condensate trap is acutely angled relative to intake air flow, wherein the upstream wall and the downstream wall form portions of an inner compressor wall spaced away from a compressor housing.

8. The system of claim 7, wherein the upstream wall is conical and its diameter decreases in a downstream direction.

9. The system of claim 7, wherein the downstream wall is flat and its diameter is fixed.

10. The system of claim 7, wherein the first condensate trap and the second condensate trap extend at least partially annularly about the upstream and downstream walls, respectively.

11. The system of claim 7, wherein each of the first condensate trap and the second condensate trap is fluidically connected to a condensate chamber configured to store condensate.

12. The system of claim 7, wherein the first condensate trap is fluidically connected to a condensate chamber downstream of a location where the first condensate trap and the second condensate trap intersect.

13. The system of claim 12, wherein the condensate chamber is fluidically connected to a condensate drain shaped to flow condensate to a water reservoir or an ambient atmosphere.

14. The system of claim 7, wherein the first condensate trap is flush with the upstream wall and does not constrict an intake air path through the compressor inlet.

15. The system of claim 7, wherein the second condensate trap is flush with the downstream wall and does not constrict an intake air path through the compressor inlet.

16. A method, comprising:

flowing a mixture of exhaust gas and intake air to a compressor; and capturing condensate accumulating on surfaces of a compressor inlet of the compressor via a first condensate trap and a second condensate trap, wherein the first condensate trap is more angled than the second condensate trap relative to a general flow direction of the mixture, wherein the first condensate trap is arranged on an upstream inner wall and the second condensate trap is arranged on a downstream inner wall.

17. The method of claim 16, wherein the second condensate trap is a step, an edge, or a web arranged on a downstream inlet wall.

18. The method of claim 17, wherein the first condensate trap is a recess or groove machined into an upstream inlet wall, and where the upstream inlet wall is farther away from a plurality of compressor blades of the compressor than the downstream inlet wall.

19. The method of claim 16, wherein the second condensate trap extends into a flow path of the mixture.

20. The method of claim 16, wherein the first condensate trap comprises an angle greater than 90° and where the second condensate trap comprises an angle less than 90°.

* * * * *